US005954195A

United States Patent [19]

Krueger et al.

[11] Patent Number: 5,954,195

[45] **Date of Patent: *Sep. 21, 1999**

[54] FOOD SERVING TRAY FOR USE WITH A SEPARATE CONTAINER

[75] Inventors: John A. Krueger, Brookfield; Ronald A. Perez, Shorewood, both of Wis.

[73] Assignee: Sparks International Inc., Brookfield, Wis.

[ * ] Notice: Under 35 U.S.C. 154(b), the term of this patent shall be extended for 540 days.

[21] Appl. No.: 08/596,564

[22] Filed: Feb. 5, 1996

[51] Int. Cl.[6] ..... B65D 21/02

[52] U.S. Cl. ..... 206/217; 206/541; 220/23.86; 220/575

[58] Field of Search ..... 206/514, 541, 206/549, 217; 220/23.83, 23.86, 574, 575

[56] References Cited

U.S. PATENT DOCUMENTS

| | | | |
|---|---|---|---|
| D. 54,971 | 4/1920 | Thompson . | |
| D. 173,944 | 2/1955 | Harris | D44/10 |
| D. 182,396 | 4/1958 | Berry | D44/10 |
| D. 194,114 | 11/1962 | Graham | D44/10 |
| D. 293,190 | 12/1987 | Flanagan, Sr. | D7/71 |
| D. 305,192 | 12/1989 | van Ertel | D7/1 |
| D. 308,461 | 6/1990 | Hosea | D7/549 |
| D. 359,885 | 7/1995 | Yanuzzi | D7/553 |
| 1,595,356 | 8/1926 | Moseman | 220/575 |
| 2,704,974 | 3/1955 | Setman | 99/422 |
| 4,219,144 | 8/1980 | Hagelberg | 229/2.5 R |
| 4,461,396 | 7/1984 | Harper | 220/23 |
| 4,516,685 | 5/1985 | French | 220/23.83 |
| 4,732,274 | 3/1988 | Bouton | 220/23.83 |
| 4,823,958 | 4/1989 | Mahmud | 220/23.83 |
| 4,938,373 | 7/1990 | McKee | 220/23.86 |
| 4,966,297 | 10/1990 | Doty | 220/23.83 |
| 4,991,713 | 2/1991 | Phillips | 206/218 |
| 5,058,737 | 10/1991 | Patterson et al. | 206/541 |
| 5,060,820 | 10/1991 | Boerner | 220/23.83 |
| 5,176,283 | 1/1993 | Patterson et al. | 206/541 |
| 5,259,528 | 11/1993 | Pace et al. | 220/23.83 |
| 5,292,028 | 3/1994 | Patterson et al. | 206/541 |
| 5,294,000 | 3/1994 | Yanuzzi | 206/562 |
| 5,346,070 | 9/1994 | McSpadden | 206/561 |
| 5,381,901 | 1/1995 | Hundley | 206/457 |
| 5,390,798 | 2/1995 | Yanuzzi | 206/562 |

*Primary Examiner*—Jim Foster
*Attorney, Agent, or Firm*—Skarsten Law Offices S.C.

[57] ABSTRACT

A tray is provided for serving selected food items, wherein the tray is to be used in connection with a separate elongated container, preferably of the type used to retain a beverage. The tray generally comprises a food holding section disposed to carry the food items, and structure for detachably mating or joining the food holding section upon the elongated container, for support thereby. Thus, the container, tray and food thereon can be readily supported and carried by a user as a single unit, by grasping the container with a single hand. In a useful embodiment the center of mass of the tray is substantially aligned along the container axis when the tray and container are joined together. Also, the food holding section and mating structure are usefully formed as an integral structure.

11 Claims, 7 Drawing Sheets

FOOD SERVING TRAY FOR USE WITH A SEPARATE CONTAINER

BACKGROUND OF THE INVENTION

The invention disclosed and claimed herein generally pertains to an improved food serving tray or plate which is intended for use with a separate container for a beverage or other edible food item. More particularly, the invention pertains to a serving tray of the above type wherein a user, by employing only a single hand, can firmly and conveniently support and carry both the tray and container.

There are numerous instances of food service wherein (1) one or more food items are served together with a beverage, and (2) it is convenient or essential for the recipient of the food items and beverage to be able to keep one of his or her hands free for some purpose. For example, it is a nearly universal practice, at many parties and other social functions, to serve food items on a plate, along with a beverage in a separate vessel or container. Accordingly, recipients of the food and beverage will tend to have both hands occupied, one with the plate and the other with the container. If a table or other horizontal supporting surface is not available, a recipient may try using the hand holding the beverage container to move food from the plate to his or her mouth. As an alternative practice, a recipient may attempt to balance the beverage container on the plate, in order to free his or her other hand for eating or other purpose, such as opening a door or shaking hands with another person. These practices tend to be very awkward, and frequently result in spillage and other undesirable consequences. Problems of the above type are also encountered at many sporting and other entertainment events where refreshments are served.

Fast food restaurants, particularly those having "drive-through" capability, provide a further example of food service having the dual characteristics set forth above. In such restaurants a motor vehicle is driven up to a window through which food is served. A typical order includes food items such as hamburgers, french fries, tacos, or the like, and a beverage such as a milk shake, carbonated beverage, or coffee. Frequently the vehicle driver, particularly if he or she is alone, will find it necessary to hold both the food and the beverage with one hand, while keeping the other hand free for further vehicle operation.

Prior art serving trays for supporting and carrying both food items and a separate beverage container are exemplified by patents such as U.S. Pat. Nos. 5,390,798 and 5,294,000, respectively issued Feb. 21, 1995 and Mar. 15, 1994 to Yanuzzi; U.S. Pat. No. 4,966,297, issued Oct. 30, 1990 to Doty; U.S. Pat. No. 4,461,396, issued Jul. 24, 1984 to Harper; and U.S. Pat. No. 4,219,144, issued Aug. 26, 1980 to Hagelberg.

Prior art food tray arrangements of the above type tend to have a very important feature in common. More particularly, in each of such arrangements, the intent is to provide a tray which is designed to receive, provide support for, and carry a beverage container or vessel. Yanuzzi and Doty both show a tray having a circular aperture, for receiving the lower portion of a container which is of frusto-conical shape and tapers downwardly. However, such design would be unable to support a straight-sided cylindrical container, such as a common aluminum soda can, since such container would slide through the aperture. In the tray arrangements disclosed by Harper and Hagelberg, the beverage container is placed directly on a portion of the tray carrying surface. However, in such arrangements the center of mass of a typical beverage container will be at a comparatively high level above the tray, particularly if the container is full. Accordingly, the container will be unstable on the tray and can easily be knocked over, if the tray is jarred or subjected to unexpected motion.

Prior art trays of the above type can conceivably be used by a person to carry both food and beverage with a single hand. However, in the event of such use, the entire support for the tray and its contents, including the beverage container thereon, will be applied at only one edge of the tray. The hand holding the tray will, therefore, not only have to support the entire weight of the tray, container, and their respective contents, but will also have to resist a moment applied thereto by gravitational force. Moreover, as discussed further in connection with the drawings, tray arrangements of the above prior art generally are not designed to make the most forceful and effective use of the human hand in grasping an object.

SUMMARY OF THE INVENTION

The invention is generally directed to a tray for serving selected food items which is to be used in connection with an elongated container, of a type used to retain a beverage or other edible item. The tray generally comprises a food holding section disposed to carry the food items, and a mating means for detachably joining the food holding section upon the elongated container for support thereby, the mating means also serving to resist lateral movement between the container and the food holding section when they are joined together and are being moved.

In a preferred embodiment, the food holding section has its center of mass at a specified location, and the mating means comprises means for joining the food holding section onto such container so that the center of mass is substantially aligned along the container axis. As used herein, "substantially aligned" means that such center of mass either intersects or is closely spaced apart from the container axis. Preferably also, the mating means is integrally formed with the food holding section. Usefully, the mating means includes structure which serves to form a seal with the annular rim or edge on the upper end of the elongated container, to prevent spillage of liquid. Thus, the mating means may also function as a sealed cover or lid for the container.

OBJECTS OF THE INVENTION

An object of the invention is to provide an improved arrangement for serving one or more food items along with a beverage or other edible item which is to be retained in a separate vessel or container.

Another object is to provide an arrangement of the above type wherein a tray or plate for receiving food items is to be supported upon and carried by a separate, preferably elongated container.

Another object is to provide an arrangement of the above type which is disposed to enable a user thereof to firmly support and carry the container, tray, and respective contents thereof simply by grasping the container with a single hand.

Another object is to provide an arrangement of the above type which may be adapted for use with a variety of common beverage container designs.

Another object is to provide an arrangement of the above type wherein the plate or tray may additionally function to provide a sealed cover for a beverage container having an open top.

Another object is to provide an arrangement of the above type wherein a number of the trays may be stacked together in compact, nesting relationship.

These and other objects of the invention will become more readily apparent from the ensuing specification, taken together with the accompanying drawings.

DETAILED DESCRIPTION OF THE PREFERRED EMBODIMENT

Figure 1:
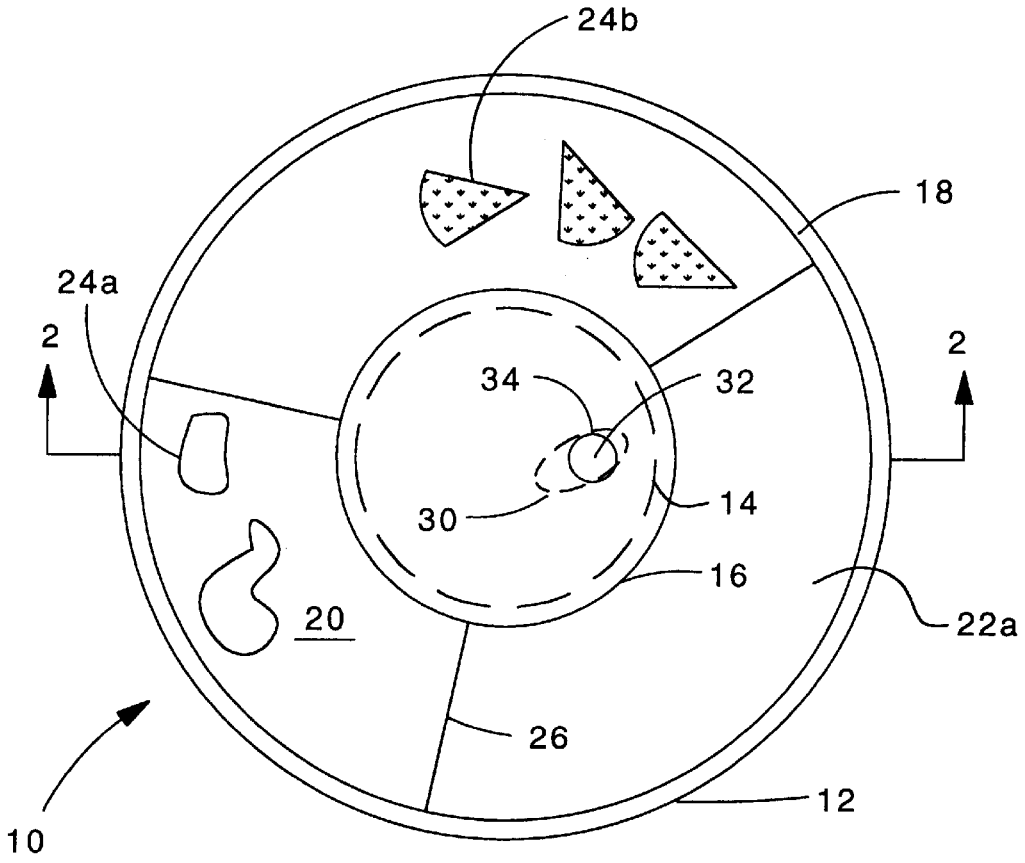
FIG. 1 is an overhead view showing an embodiment of the invention.
Figure 2:
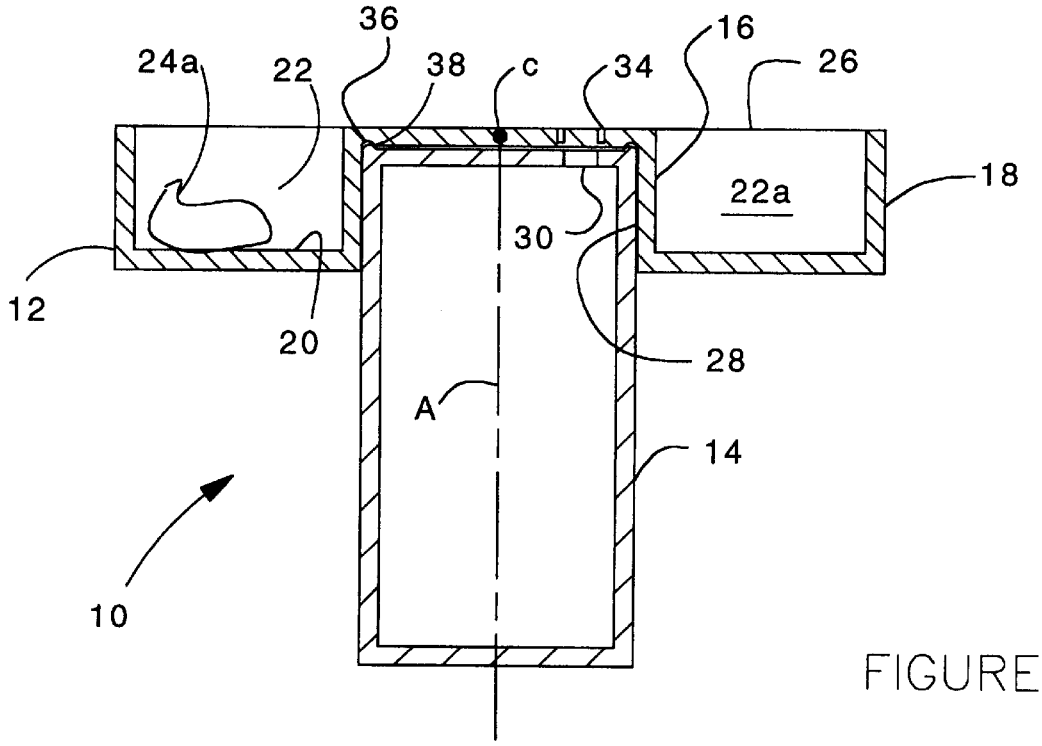
FIG. 2 is a sectional view taken along lines 2—2 of FIG. 1.

Referring to FIGS. 1 and 2 in combination, there is shown a food serving arrangement 10 comprising a tray or plate 12, which is joined to and supported upon a generally cylindrical container 14. Tray 12 comprises a central hub 16, an annular outer wall 18, and an annular food carrying surface 20. Wall 18 and hub 16 extend upwardly from surface 20, so that wall 18, hub 16, and surface 20 together define a region 22 for holding food items, such as 24*a* and 24*b*.

A wall 26, extending radially between hub 16 and annular wall 18, may also be provided to divide region 22 into compartments 22*a* to receive different types of food items. Tray 12 is usefully formed as an integral structure from inexpensive and non-durable material such as paper, plastic or styrofoam, following practices well known in the art. Accordingly, tray 12 may be of a disposable nature. Alternatively, tray arrangement 10 could be formed of porcelain, metal, or other durable material.

Referring further to FIG. 2, there is shown an inner cylindrical surface 28 formed within hub 16. Cylindrical surface 28 is sized in relation to the outer diameter of cylindrical container 14 so that hub 16 can be placed over the upper portion of container 14 in snug fitting relationship therewith. Thus, by pressing tray 12 onto container 14, the two can be readily joined into a unit which can be supported and carried by grasping the container 14 with a single hand, as described hereafter in connection with FIG. 3. The snug fit prevents lateral movement between the tray 12 and container 14 as the two are carried. When and if desired, they can readily be separated back into two independent units. Tray 12 is designed, for reasons set forth hereafter, so that when hub 16 is fitted thereon, the center of mass C of the tray is substantially aligned along the cylindrical axis A of container 14, i.e., lies on such axis or very close thereto.

Container 14 usefully comprises a standard-size commercially available container or vessel, such as an aluminum can of a type commonly used to dispense beer, soda, and various other carbonated and noncarbonated beverages. As is known, such cans generally have an opening 30 in their upper ends. Tray 12 is formed to provide a knock-out 32 for a straw (not shown) by inscribing a groove 34 in the hub 16. When knock-out 32 is punched out or otherwise removed from hub 16, an opening is provided therethrough which can be aligned with the opening 30 by rotating the plate 12 and container 14 with respect to one another. A straw may then be inserted through the two aligned openings to provide access to the contents of the container. Annular space 36 is usefully formed on the underside of hub 16, to receive an annular rim 38 on the upper end of the cylindrical commercially available can.

In an alternate food serving arrangement 10, container 14 comprises a cylindrical beverage container having its upper end open. The upper edge of the container surrounding such upper end is receivable into the annular space 36 in the underside of hub 16 in snug fitting relationship. If tray 12 is formed of compliant material such as styrofoam or plastic, the tray 12, when fitted upon the container, will function as a sealed cover therefor to prevent the liquid contents of the container 14 from being spilled. Such sealing effect between the tray and container may alternatively be achieved if the container is more compliant than the tray.

Figure 3A:
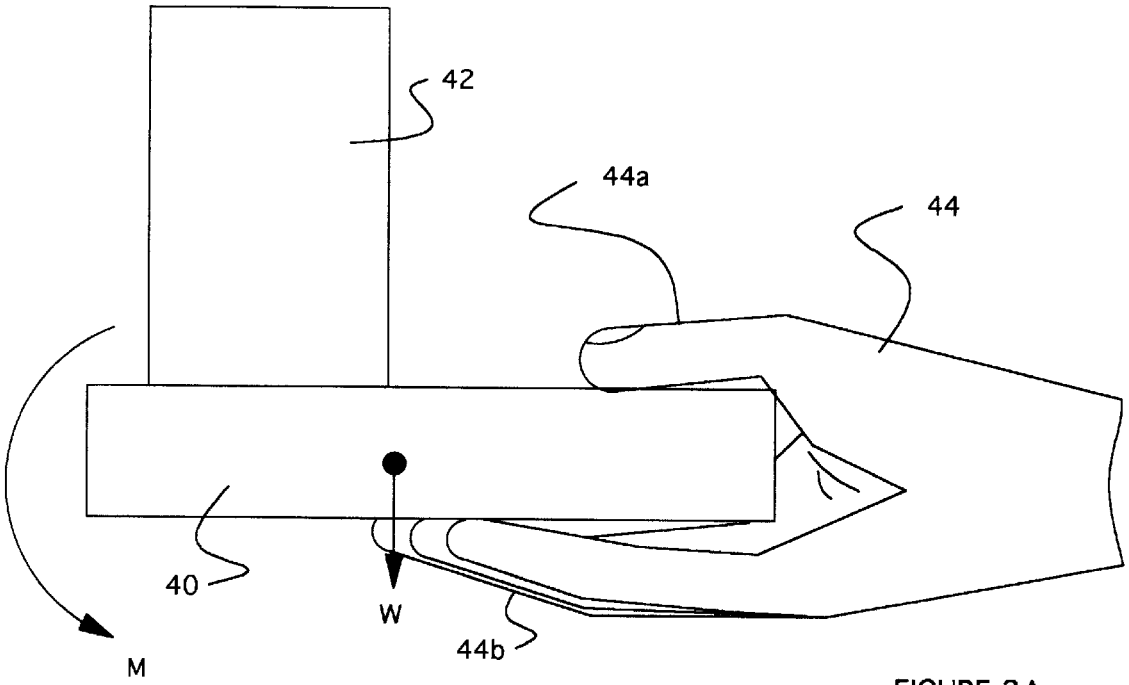
FIGURE 3A PRIOR ART
FIGS. 3 is a set of views for comparing a feature of the invention with the prior art.

Referring to FIG. 3A, there is shown a tray 40, of a common prior art design, having a beverage container 42 positioned thereon. The combined weight of the tray 40 and container 42, together with food and beverage respectively held thereby (not shown) is W. FIG. 3A further shows tray 40 and container 42 solely supported by one hand 44 of a user (not otherwise shown), the hand having a thumb 44*a* and four fingers 44*b* opposing the thumb. Typically, such support will be provided by gripping one side or edge of tray 40 between the thumb 44*a* and the fingers 44*b*, the fingers 44*b* being placed underneath the tray. Such means of support, in addition to resisting the combined weight W, will have to oppose a moment M applied to the tray 40 by gravitational force. Moment M tends to rotate the tray 40 downwardly, and increases as beverage container 42 is moved away from the edge of tray 40 held by hand 44. Some users, such as children or weaker persons, may find it very difficult to hold the tray 40 with a single hand, in the manner shown in FIG. 3A, for more than a brief period of time, if at all.

Figure 3B:
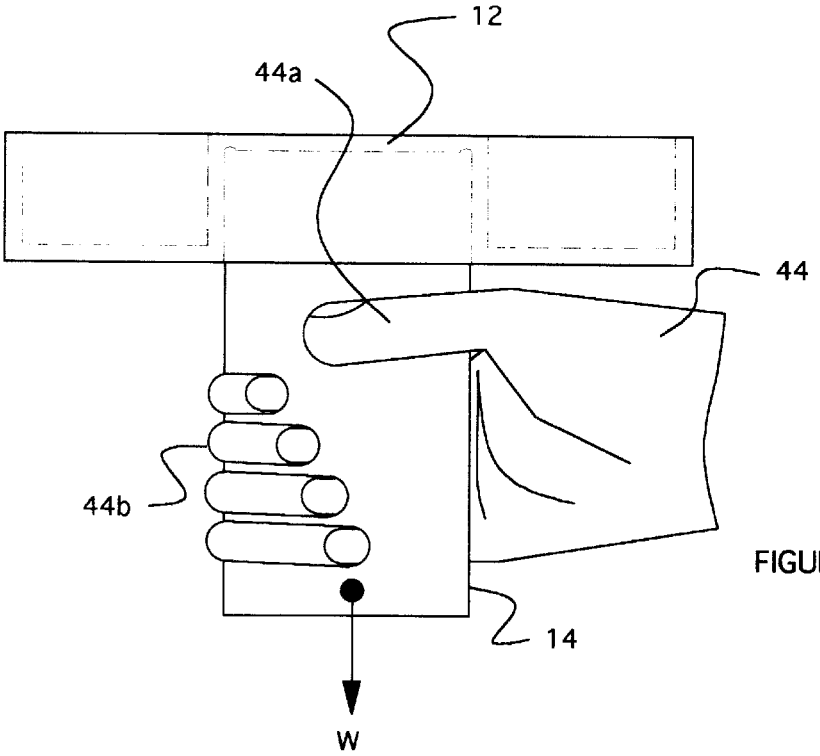

Referring to FIG. 3B, there is shown the tray 12 mounted on container 14 as described above, the combined weight of tray 12, container 14, and food and beverage respectively held thereby (not shown) likewise having a combined weight W. FIG. 3B further shows the single hand 44 of a user engaging both a tray 12 and container 14 by grasping container 14, such that the thumb 44*a* and opposing fingers 44*b* are wrapped around container 14 in opposing relationship with each other. The elongated container 14 thus serves as a "carrying handle" for both the tray 12 and container 14. It is considered that the muscles of the hand 44 will generally be able to apply significantly more strength to a container 14, held as shown in FIG. 3B, then to a tray 42 held as shown in FIG. 3A. Moreover, since the center of mass of tray 12 lies along, or very close to, the container axis A, any moment applied to hand 44 by the arrangement shown in FIG. 3B will be significantly less than the moment M applied thereto by the arrangement of FIG. 3A.

Figure 4:
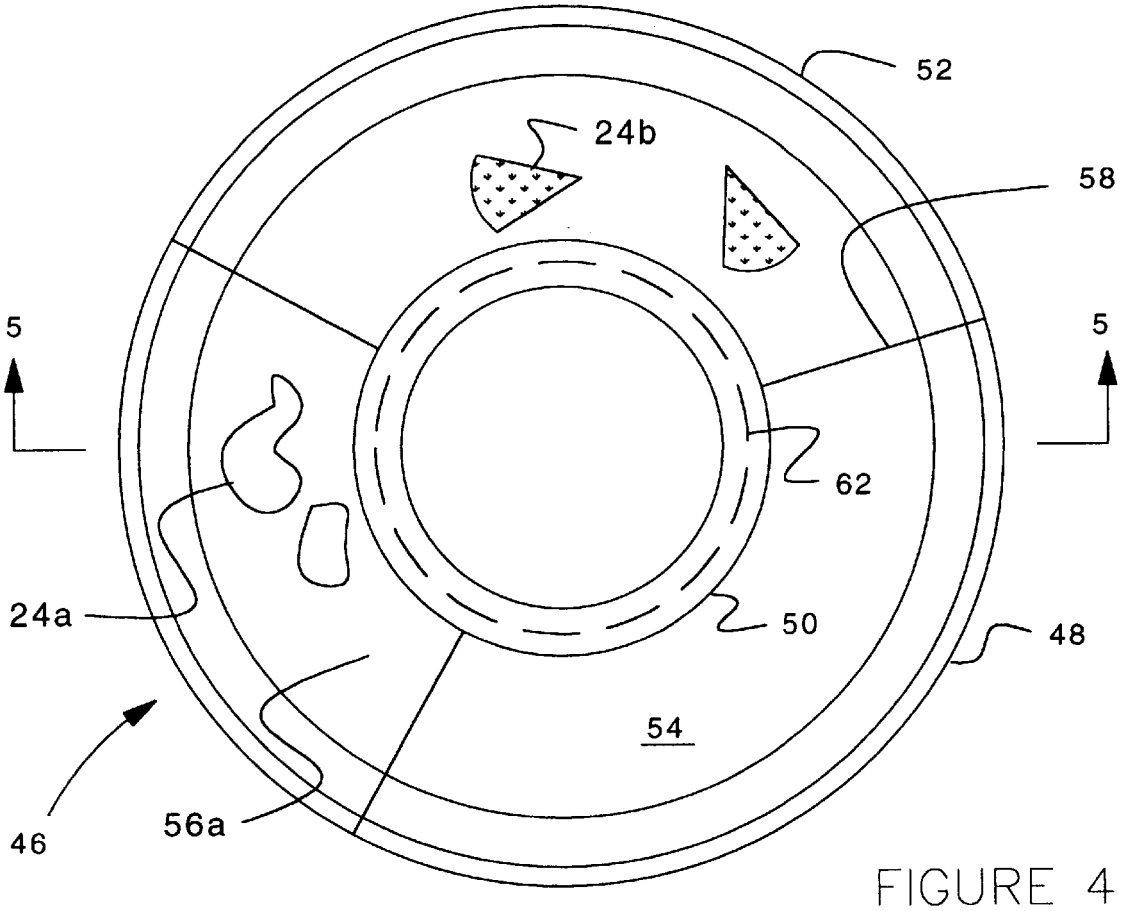
FIG. 4 is an overhead view showing a second embodiment of the invention.
Figure 5:
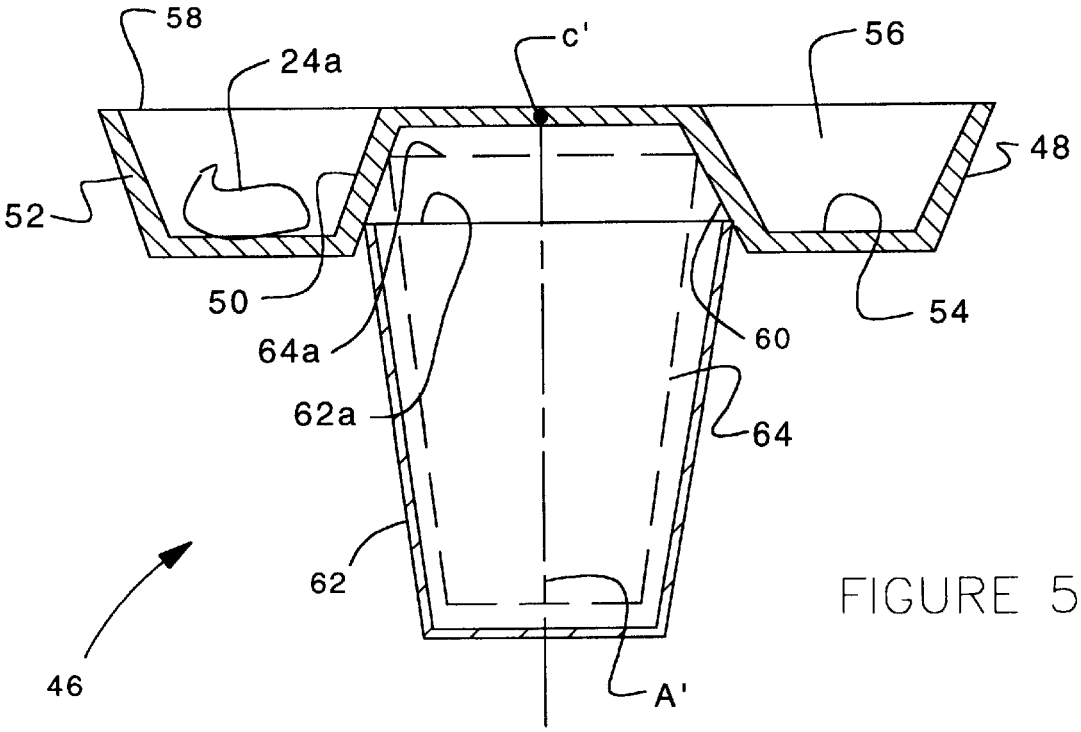
FIG. 5 is a sectional view taken along lines 5—5 of FIG. 4.
Figure 6:
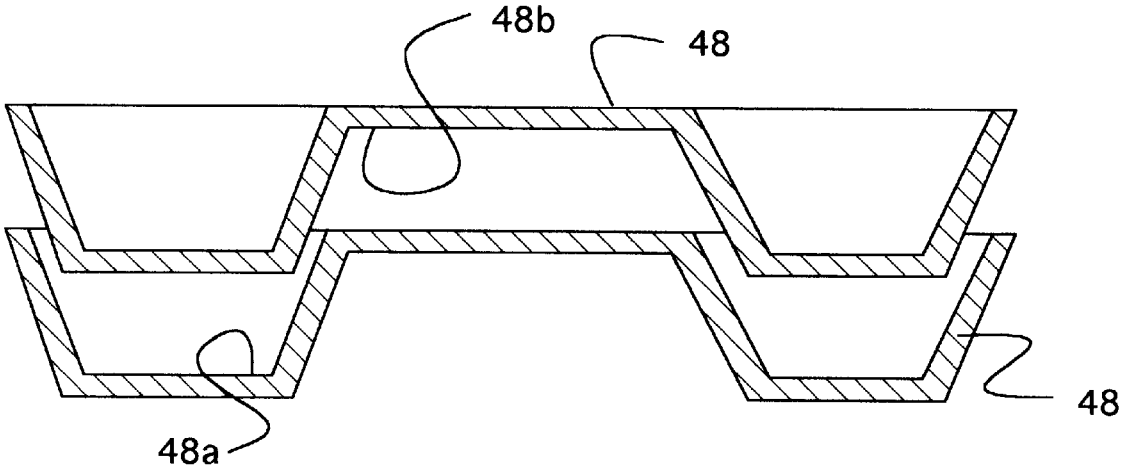
FIG. 6 is a view illustrating stackability of a plurality of the embodiments shown in FIGS. 4 and 5.

Referring to FIGS. 4 and 5 in combination, there is shown a food serving arrangement 46, which includes a tray 48 comprising a central hub 50, an annular outer wall 52, and an annular food carrying surface 54. Wall 52 and hub 50 extend upwardly from surface 54, so that wall 52, hub 50, and surface 54 together define a region 56 for holding food items 24*a* and 24*b*. In like manner with arrangement 10, walls 58 may extend radially between hub 50 and annular wall 52 to divide region 56 into compartments 56*a*, to receive different types of food items, and tray 48 is usefully formed as an integral structure from paper, plastic, or styrofoam. However, annular wall 52 and the side of hub 50 of tray 48 are respectively designed to taper, as shown in FIG. 5, and an inner surface 60 is formed within hub 50 so as to have a frusto-conical shape which tapers upwardly, as viewed in FIG. 5. Thus, as viewed in FIG. 6, the top side 48*a* of one tray 48 can be brought into closely fitting relationship with the underside 48*b* of another tray 48. A series of trays 48 may thereby be stacked together for convenient sale, storage, and handling.

Referring further to FIG. 5, there is shown tray 48 seated upon and supported by a container 62, which has an open top and is of frusto-conical shape. Usefully, container 62 comprises a common disposable cup of the type formed of plastic or paper and widely used to serve hot and cold beverages. By forming tray 48 of a compliant material such as styrofoam, it may be readily pressed down onto container 62, so that tray 48 and container 62 become joined together. They may then be supported and carried together as a unit, as described above, by grasping container 62 with a single hand. Also, a seal is thereby formed between the upper edge 62*a* of container 62, and the frusto-conical inner surface 60 of hub 50. When tray 48 and container 62 are joined together in such manner, the center of mass C' of tray 48 intersects or is closely spaced from the axis A' of container 62.

By providing an inner surface 60 of frusto-conical shape within hub 50, tray 48 may be used with frusto-conical containers of varying size and dimensions. Thus, FIG. 5 shows tray 48 alternatively used with a container 64 (represented by a dashed line), where the edge 64*a* of container 64 is of smaller diameter than the edge 62*a* of container 62.

Figure 7:
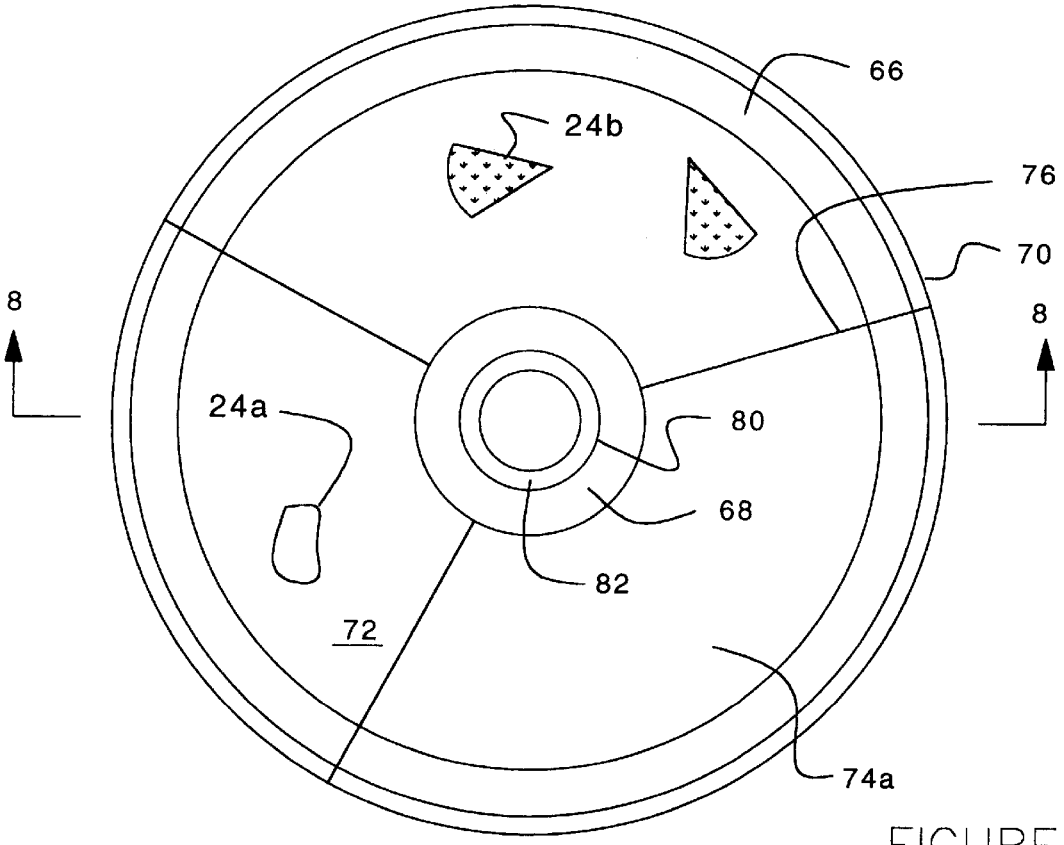
FIG. 7 is an overhead view showing a third embodiment of the invention.
Figure 8:
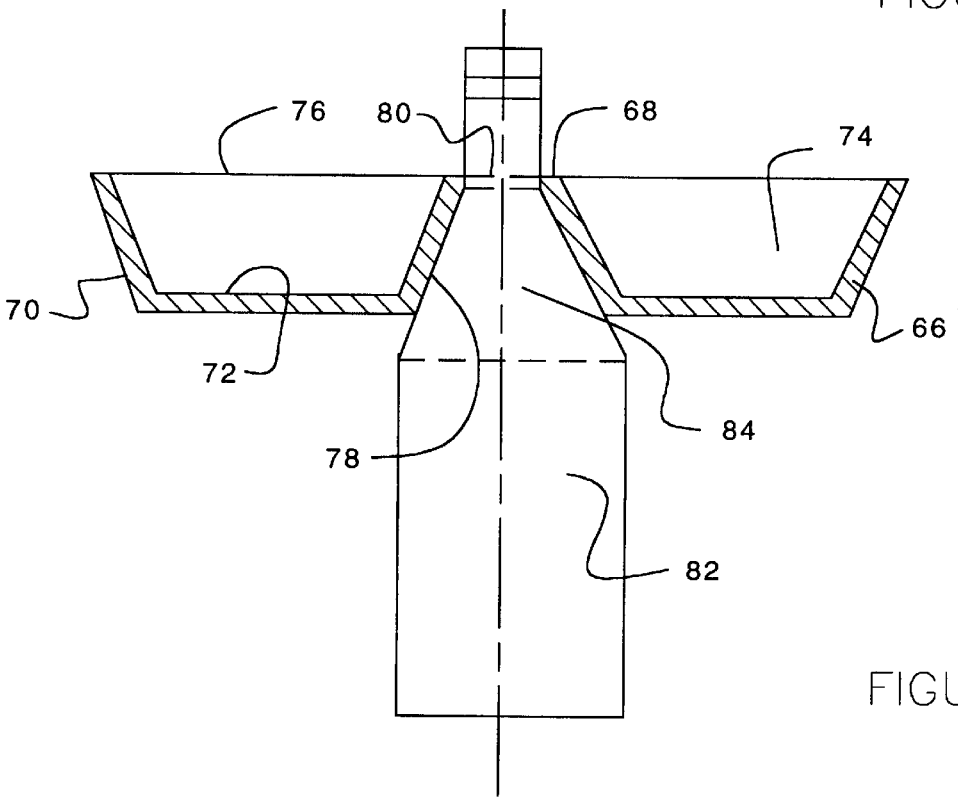
FIG. 8 is a sectional view taken along lines 8—8 of FIG. 7.

Referring to FIGS. 7 and 8 in combination, there is shown a tray 66 comprising a central hub 68, an annular wall 70, and an annular food carrying surface 72. Wall 70 and hub 68 extend upwardly from surface 72, so that wall 70, hub 68 and surface 72 together define a region 74 for holding food items 24*a* and 24*b*. Walls 76 may extend radially between hub 68 and annular wall 70 to divide region 74 into compartments 74*a*, to receive different types of food items. Tray 66 is usefully formed as an integral structure from paper, plastic, styrofoam, or the like. In like manner with tray 48 described above, the annular wall 70 and the side of hub 68 of tray 66 are respectively designed to taper, as best shown in FIG. 8, and a frusto-conical inner surface 78 is formed within hub 68. In addition, a circular aperture 80 is formed through the top of hub 68. Tray 66 may thereby be pressed down upon and supported by a container 82, comprising a bottle having a tapering neck 84. Frusto-conical surface 78 is usefully designed to mate with the tapered neck of a type of bottle having wide commercial use.

After tray 66 has been placed upon the bottle 82, the combined arrangement may be supported and carried as a unit, by grasping bottle 82 with a single hand, as described above. The centers of circular aperture 80 and tray 66 coincide, so that the center mass of tray 66 is substantially aligned along the axis of a bottle 82, when the tray and bottle are joined together as shown in FIG. 8.

Figure 9:
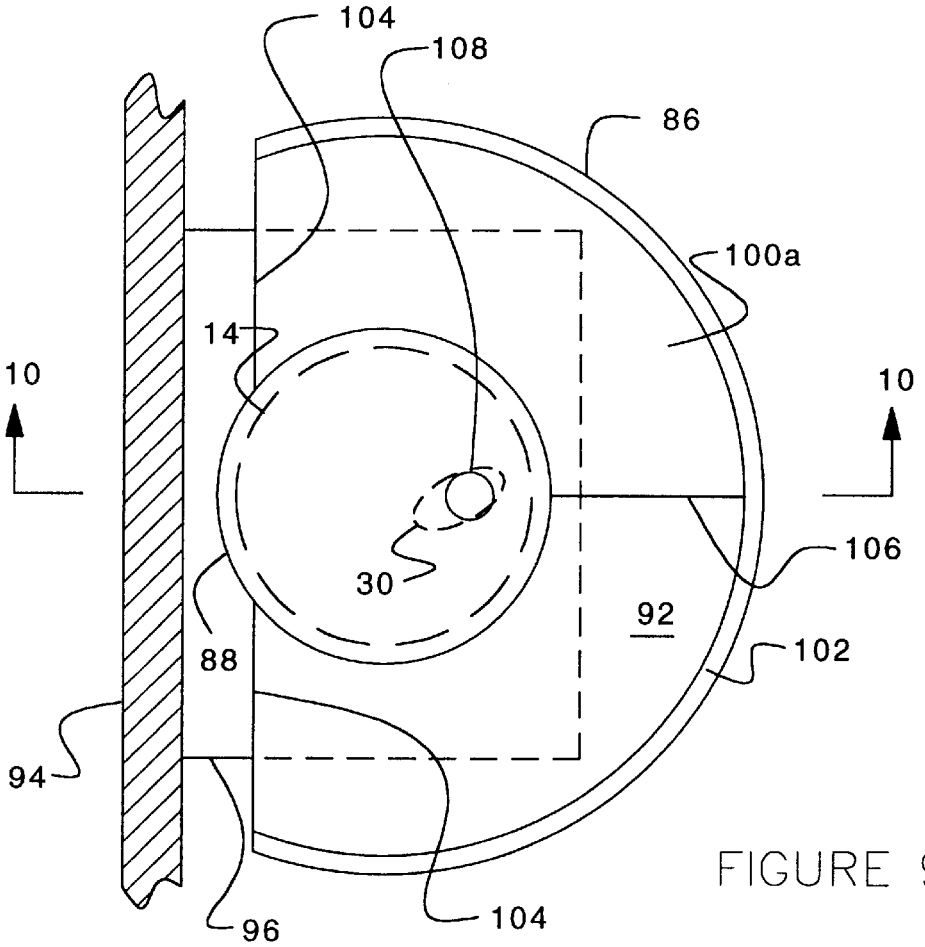
FIG. 9 is an overhead view showing a fourth embodiment of the invention.
Figure 10:
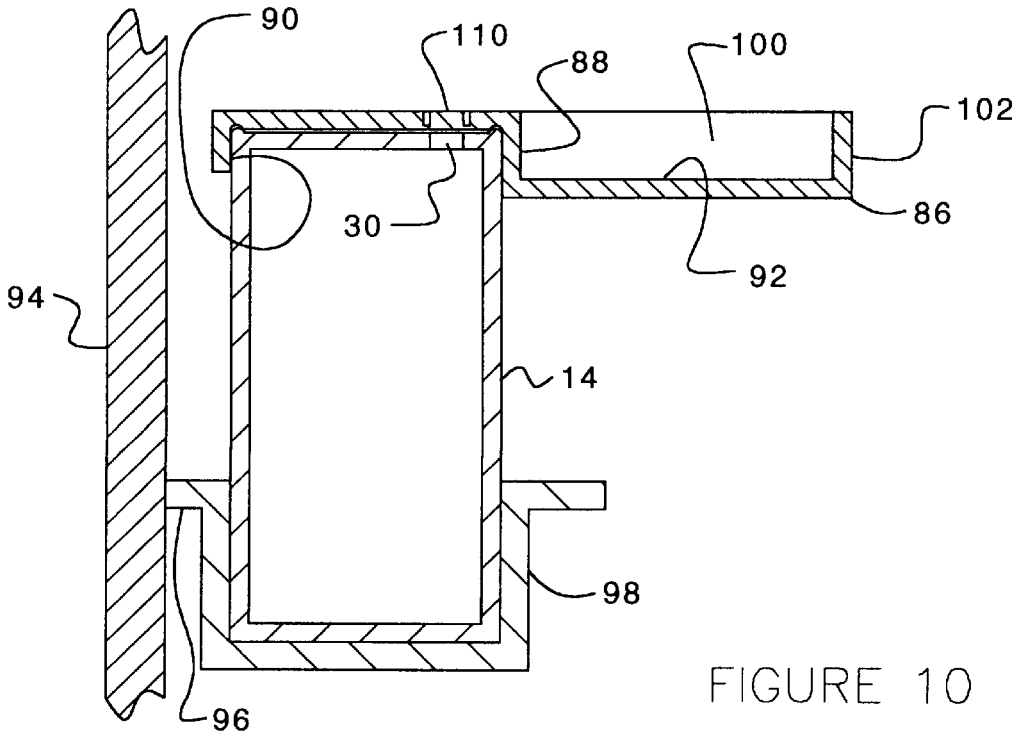
FIG. 10 is a sectional view taken along lines 10—10 of FIG. 9.

Referring to FIGS. 9 and 10 in combination, there is shown a cylindrical container 14, as described above in connection with FIGS. 1 and 2 of the drawings, with a tray 86 supported thereon. Tray 86 includes a hub 88 having an inner cylindrical surface 90 formed therein. Cylindrical surface 90 is sized in relation to the outer diameter of cylindrical container 14 so that hub 88 can be placed over the upper portion of container 14 in snug fitting relationship therewith. Thus, by pressing tray 86 onto container 14, they are readily joined into a unit which can be supported by container 14. Unlike previously described embodiments, however, tray 86 has a food carrying surface 92 comprising only a section of an annulus, such as a semi-annular section. Thus, tray 86 can be supportably carried on container 14 when the container is supported in closely spaced relationship with a wall 94, such as by means of beverage container holder 96, attached to and extending outwardly from the wall 94. Beverage holders of such type are increasingly used, for example, in vans and autos to carry beverages purchased at fast food restaurants. FIG. 10 more particularly shows the lower portion of container 14 inserted into a complementary sized well 98 formed in holder 96. Alternatively, holder 96 could be provided with a circular hole or aperture for receiving the lower portion of a frusto-conical shaped container.

Referring further to FIGS. 9 and 10, there is shown a food holding region 100 which is generally defined by hub 88, surface 92, an outer wall 102 positioned around the outer edge of surface 92, and walls 104 extending radially between hub 88 and wall 102 at opposing ends of surface 92. A wall 106 extending radially between hub 88 and wall 102 may be provided to divide region 100 into compartments 100*a*. FIGS. 9 and 10 further show a straw knock-out 108, formed in hub 88 by inscribing a circular groove 110 therein. Knock-out 108 may be aligned with opening 30 in the top of container 14 as previously described.

Figure 11:
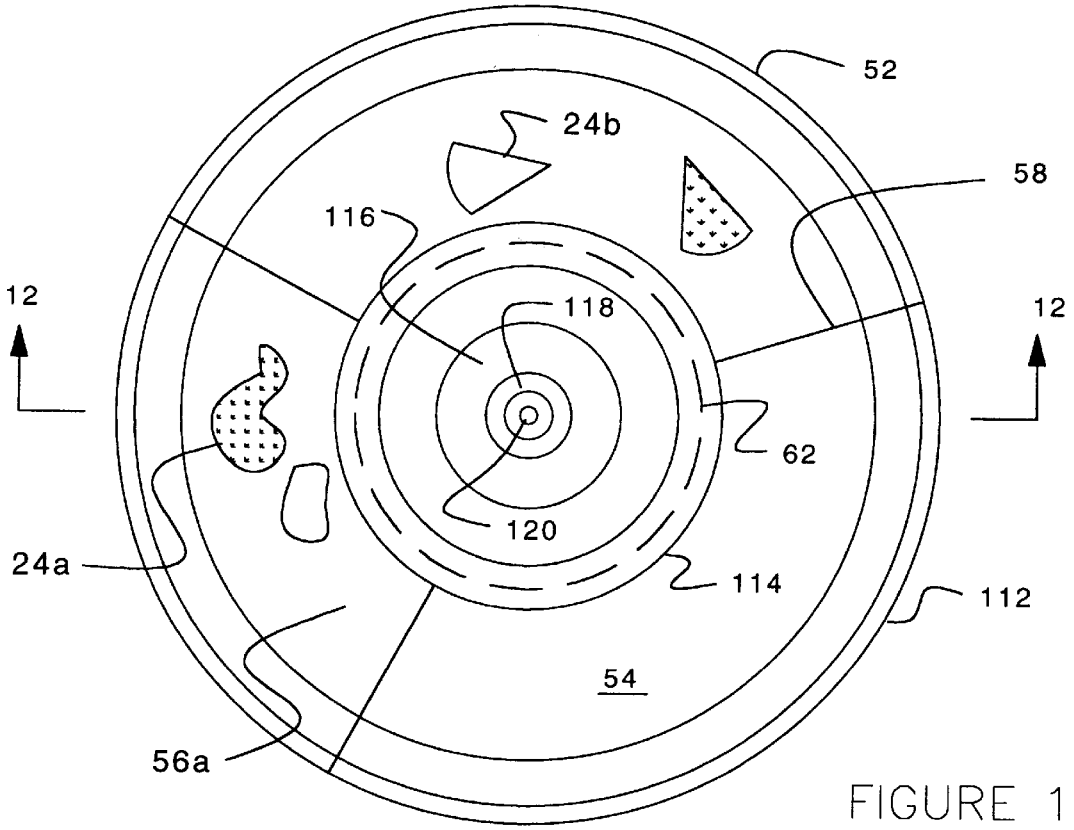
FIG. 11 is an overhead view showing a modification of the embodiment shown in FIGS. 4 and 5.
Figure 12:
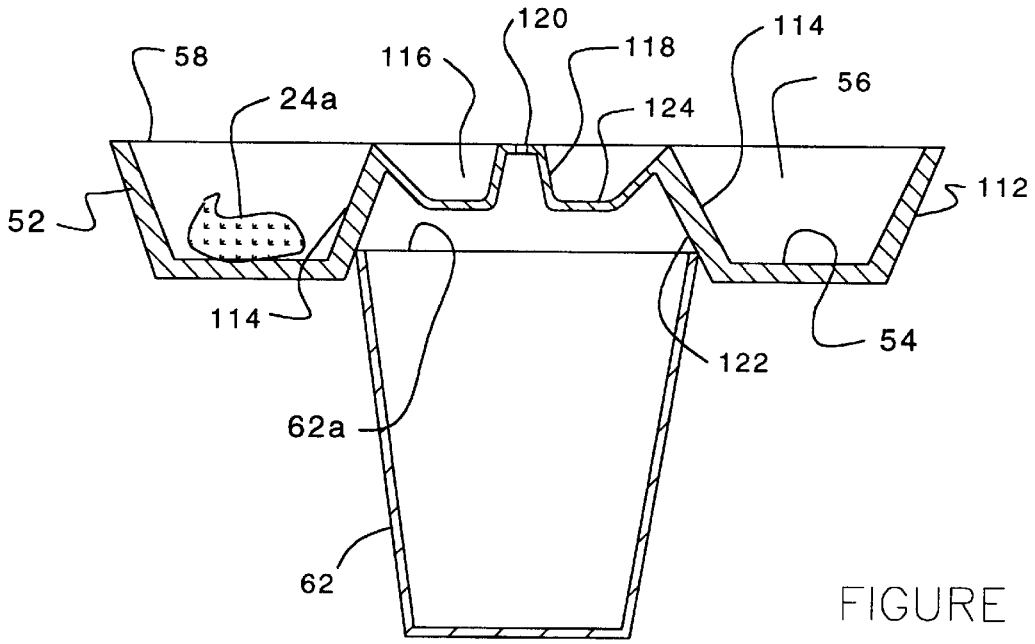
FIG. 12 is a sectional view taken along lines 12—12 of FIG. 11.

Referring to FIGS. 11 and 12 in combination, there is shown a tray 112 comprising a modification of the embodiment shown in FIGS. 4 and 5, wherein a hub 114 is substituted for the hub 50. Hub 114 is formed to provide a well 116 around the center of an embossed or raised portion 118 having a circular straw knock-out 120 in the top thereof. Well 116 thus provides an additional compartment for food items or condiments. Features in FIGS. 11 and 12 having the same reference numbers as features shown in FIGS. 4 and 5 are respectively the same as or similar to such features.

Referring further to FIG. 12, there is shown hub 114 provided with a frustoconical inner surface 122, in sealed, abutting relationship with a beverage container 62, as described above. FIG. 12 further shows a wall 124, comprising the portion of hub 112 which defines well 116, to be of substantially less thickness than the remaining structure of tray 112. This is done to minimize the resistance to heat flow provided by wall 124. Thus, if container 62 is filled with a hot beverage such as coffee, heat rising therefrom will be more easily transferred to a food item in well 116. This is desirable if well 116 contains a food item such as nacho cheese, which is preferably kept warm. A similar effect may be realized if container 62 is filled with a very cold beverage, and well 116 contains a food item such as ice cream, which is preferably kept cold.

Alternatively, wall 124 could be formed from a material having comparatively high heat conductivity.

Obviously, many modifications and variations of the present invention are possible in light of the above teachings. For example, the associated container is not limited to a container which is elongated, in the sense of having an axial dimension which is greater than another dimension or which only holds a beverage. Thus, the separate container could alternatively hold a solid food item. Also, it is anticipated that the tray could have a variety of shapes besides circular. It is therefore to be understood that within the scope of the disclosed inventive concept, the invention may be practiced otherwise than as specifically described.

What is claimed is:

1. A food serving arrangement comprising:

an elongated cylindrical container disposed to a hold a selected beverage or food;

a food holding section having a specified food holding orientation; and a hub joined to said food holding section in substantially fixed relationship, said hub comprising a single cylindrical wall provided with a cylindrical inner surface disposed to detachably engage an upper portion of the outer surface of said cylindrical container in snug fitting relationship, said inner surface extending vertically above said food holding section when said section is in said specified orientation.

2. The arrangement of claim 1 wherein:

said container has an upper end proximate to said upper portion which is substantially closed by a cover.

3. The arrangement of claim 2 wherein:

said food holding section and said hub are formed together as an integral structure.

4. The arrangement of claim 3 wherein:

said integral structure has a center of mass at a specified location; and said hub comprises means for joining said integral structure to said container so that said center of mass is substantially aligned along the axis of said elongated container.

5. The arrangement of claim 3 wherein:

said food holding section comprises an annular structure having a center lying along the axis of said hub.

6. The arrangement of claim 3 wherein:

said hub comprises means for joining said food holding section onto said container proximate to an edge of said food holding section.

7. The arrangement of claim 3 wherein:

said integral structure comprises one of a plurality of substantially identical trays, the top of a first one of said trays being disposed to fit against the underside of a second one of said trays in a complementary relationship; and said beverage container comprises a rigid material.

8. The arrangement of claim 2 wherein:

said hub forms a seal with said container when said inner surface engages said container.

9. A tray for serving selected food items in connection with a separate cylindrical beverage container having an upper end which is substantially closed by a cover, said tray comprising:

a food holding section having a specified food holding orientation; and a hub joined to said food holding section in substantially fixed relationship, said hub comprising a single cylindrical wall provided with a cylindrical inner surface disposed to engage an upper portion of the outer surface of said cylindrical container in snug-fitting relationship, said inner surface extending vertically above said food holding section when said section is in said specified orientation.

10. The tray of claim 9 wherein:

said food holding section and said hub are formed together as an integral structure.

11. A tray for serving selected food items in connection with a separate beverage container, an upper portion of the outer surface of said container being cylindrically shaped, said tray comprising:

a food holding section having a specified food holding orientation; and a hub joined to said food holding section in substantially fixed relationship, said hub provided with a cylindrical inner surface formed in complementary relationship to said cylindrically shaped portion of said container and disposed to engage said cylindrically shaped portion in snug-fitting relationship, said inner surface extending vertically above said food holding section when said section is in said specified orientation.

* * * * *